US005530399A

United States Patent [19]

Chambers et al.

[11] Patent Number: 5,530,399

[45] Date of Patent: Jun. 25, 1996

[54] TRANSCONDUCTANCE SCALING CIRCUIT AND METHOD RESPONSIVE TO A RECEIVED DIGITAL CODE WORD FOR USE WITH AN OPERATIONAL TRANSCONDUCTANCE CIRCUIT

[75] Inventors: Mark J. Chambers, Chandler, Ariz.; James B. Phillips, North Richland Hills, Tex.

[73] Assignee: Motorola, Inc., Schaumburg, Ill.

[21] Appl. No.: 363,786

[22] Filed: Dec. 27, 1994

[51] Int. Cl.[6] ..... G06G 7/12

[52] U.S. Cl. ..... 327/561; 327/103; 330/252; 330/278; 330/291

[58] Field of Search ..... 327/560, 561, 327/562, 563, 103; 330/252, 254, 277, 278, 279, 282, 291, 305

[56] References Cited

U.S. PATENT DOCUMENTS

| | | | |
|---|---|---|---|
| 4,859,955 | 8/1989 | Trethewey | 327/170 |
| 4,926,063 | 5/1990 | Donaldson | 307/144 |
| 4,990,916 | 2/1991 | Wynne et al. | 341/147 |
| 4,999,586 | 3/1991 | Meyer et al. | 330/288 |
| 5,001,441 | 3/1991 | Gen-Kuong | 330/294 |
| 5,410,274 | 4/1995 | Birdsall et al. | 330/265 |

OTHER PUBLICATIONS

Vol. 26, No. 12 Dec. 1991 IEEE Journal of Solid State Circuits; Design of a 15–MHz CMOS Continuous Time Filter with On–Chip Tuning, John M. Khoury.

*Primary Examiner*—Timothy P. Callahan
*Assistant Examiner*—Kenneth B. Wells
*Attorney, Agent, or Firm*—Barbara R. Doutre; John G. Rauch

[57] ABSTRACT

A transconductance scaling circuit (500) includes an operational transconductance amplifier (504) having a tunable voltage, $V_{tune2}$. A feedback loop controls the tunable voltage, $V_{tune2}$, in response to the digital programming of the transconductance amplifier (504) and provides the tunable voltage as a current scaling output.

18 Claims, 4 Drawing Sheets

—PRIOR ART—

—PRIOR ART—

—PRIOR ART—

—PRIOR ART—

TRANSCONDUCTANCE SCALING CIRCUIT AND METHOD RESPONSIVE TO A RECEIVED DIGITAL CODE WORD FOR USE WITH AN OPERATIONAL TRANSCONDUCTANCE CIRCUIT

TECHNICAL FIELD

This invention relates in general to operational transconductance amplifiers and more specifically to the tuning of metal-oxide-semiconductor (MOS) operational transconductance amplifiers.

BACKGROUND

Integrated operational transconductance amplifier (OTA) circuits are used in a wide array of applications such as filtering or signal level regulation (i.e., gain or attenuation blocks). A commonly used topology for an OTA is given in FIG. 1 of the accompanying drawings. The OTA 100 includes two functional elements: an input voltage-to-current converter 102 characterized by transconductance $gm_0$ and a programmable linear current scaling circuit 104 with an input to output current gain ratio $A_I$. The current gain $A_I$ is a function of bias currents $I_1$ and $I_2$ as given in the following equation:

$$A_I = k(I_2/I_1)$$

where k is a constant of proportionality. The resulting transconductance for the OTA 100 is given by the following equations:

$$\begin{aligned} Gm &= Iout/(in^+ - in^-) \\ &= k(gm_0)(I2/I1). \end{aligned}$$

In the application of the OTA 100 in an integrated transconductance-capacitor (Gm-C) filter, Gm is tuned and/or programmed to achieve some desired bandwidth. The tuning circuit is often a phase lock loop which tunes Gm so that the ratio of Gm/C is some desired value where C is the filter capacitance. For the OTA 100, the bias current $I_1$ is typically set by the tuning circuit, and $I_2$ is typically a programmable value that enables linear scaling of the bandwidth with respect to a reference current set by $I_1$. A common implementation of the OTA 100 uses a current steering digital-to-analog converter (D/A) to set the value for $I_2$, thus enabling digital programming of the filter bandwidth.

In bipolar or Bipolar-CMOS technology, the current scaling element is typically a bipolar "translinear amplifier" such as the one depicted in FIG. 2 of the accompanying drawings. In bipolar transistor technology, the output current, $I_{out}$, of the translinear amplifier 200 is proportional to the exponential of the input voltage, $I_{out} \propto \exp(V_{be}/V_T)$, where $V_T$ is the thermal voltage. As a result, the current gain of the bipolar translinear amplifier 200 is exactly proportional to the ratio of $I_2/I_1$ as in the first equation. Thus, the desired linear scaling of Gm can be performed by adjusting the $I_2/I_1$ ratio.

In MOS technology, however, the output current of the transistor is proportional to the quadratic of the input voltage, $I_{out} \propto (V_{gs}-V_T)^2$ where $V_T$ is the threshold voltage. As a result, the current gain of a MOS translinear amplifier shown in FIG. 3 of the accompanying drawings is not exactly proportional to $I_2/I_1$, but is a non-linear function of this ratio. Furthermore, the current gain is also dependent on the nominal value of the input current $I_{in}$ as well as the carrier mobility, μ, which is highly process and temperature dependent.

FIG. 4 of the accompanying drawings shows an example of a typical voltage tunable complementary MOS OTA 400 implementing a translinear amplifier current scaling circuit 402, similar to the one shown in FIG. 3. Here the nominal Gm is set by resistor Rgm, and the Gm "tuning" is performed by adjusting the tuning bias voltage, Vtune, to the N-channel MOS differential pairs, MN1, MN2 and MN3, MN4. Bias currents Iss represent the DC biasing for the MOS OTA 400. As a result of the non-linear transistor gain, wide dynamic range current scaling (and consequently Gm scaling) is more problematic for MOS technology than bipolar technology.

Hence, there is a need for a circuit in MOS technology that emulates the linear behavior of the bipolar "translinear amplifier" in order to obtain deterministic scaling of the OTA transconductance.

DETAILED DESCRIPTION OF THE PREFERRED EMBODIMENT

An operational transconductance amplifier (OTA) is a device that outputs a current which is proportional to a differential voltage input. Transconductance, Gm, is defined as the differential of the output current divided by the differential of the input voltage.

Figure 1:
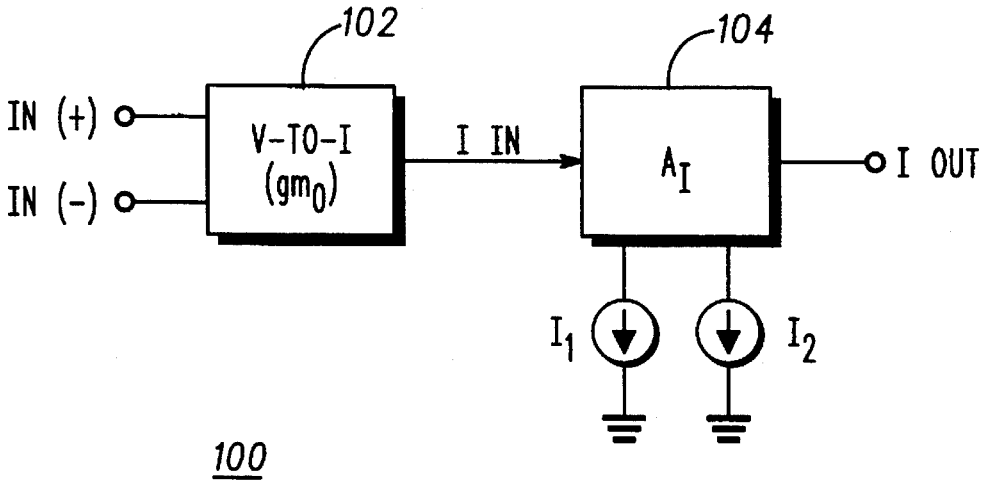
FIG. 1 is a block diagram of a prior art operational transconductance amplifier (OTA).
Figure 2:
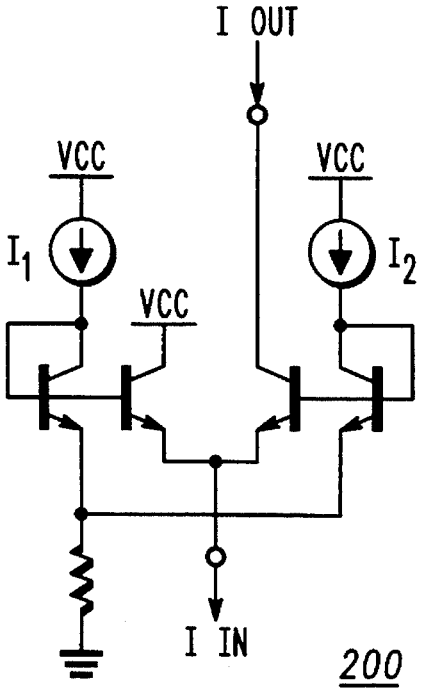
FIG. 2 is a circuit diagram of a prior art bipolar translinear amplifier.
Figure 3:
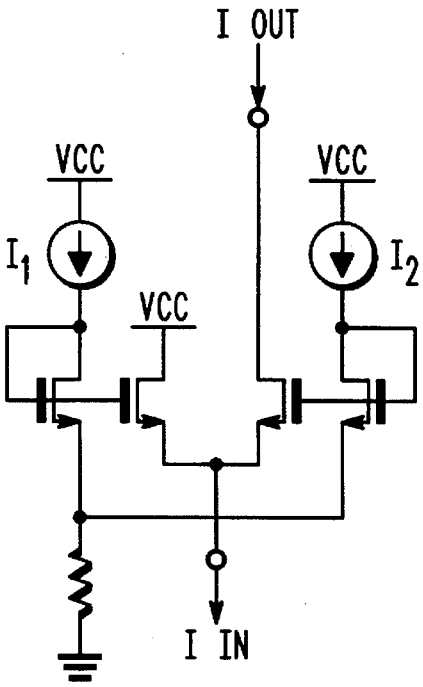
FIG. 3 is a circuit diagram of a prior art MOS translinear amplifier.
Figure 4:
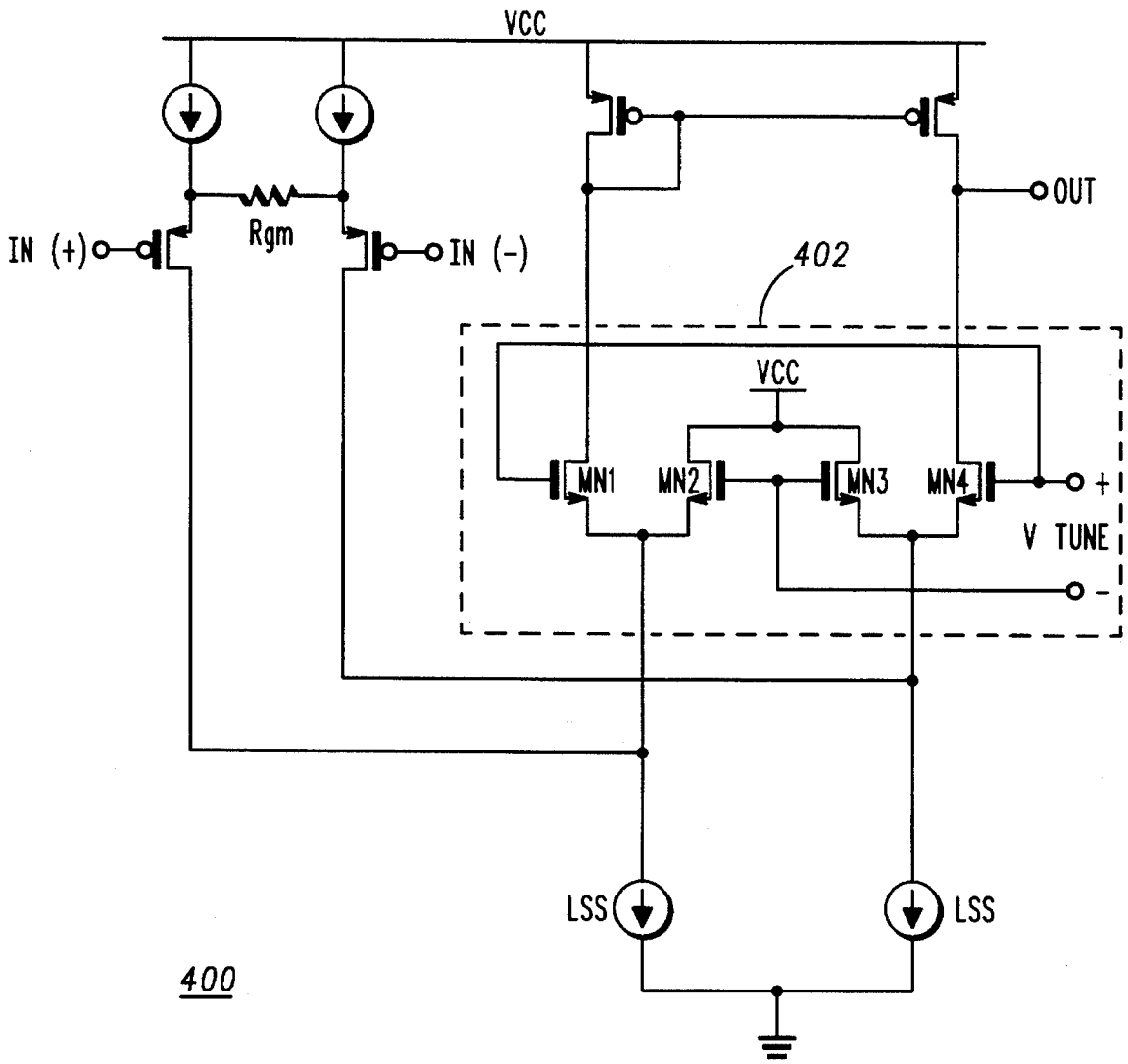
FIG. 4 is a circuit diagram of a prior art voltage tunable CMOS operational transconductance amplifier.
Figure 5:
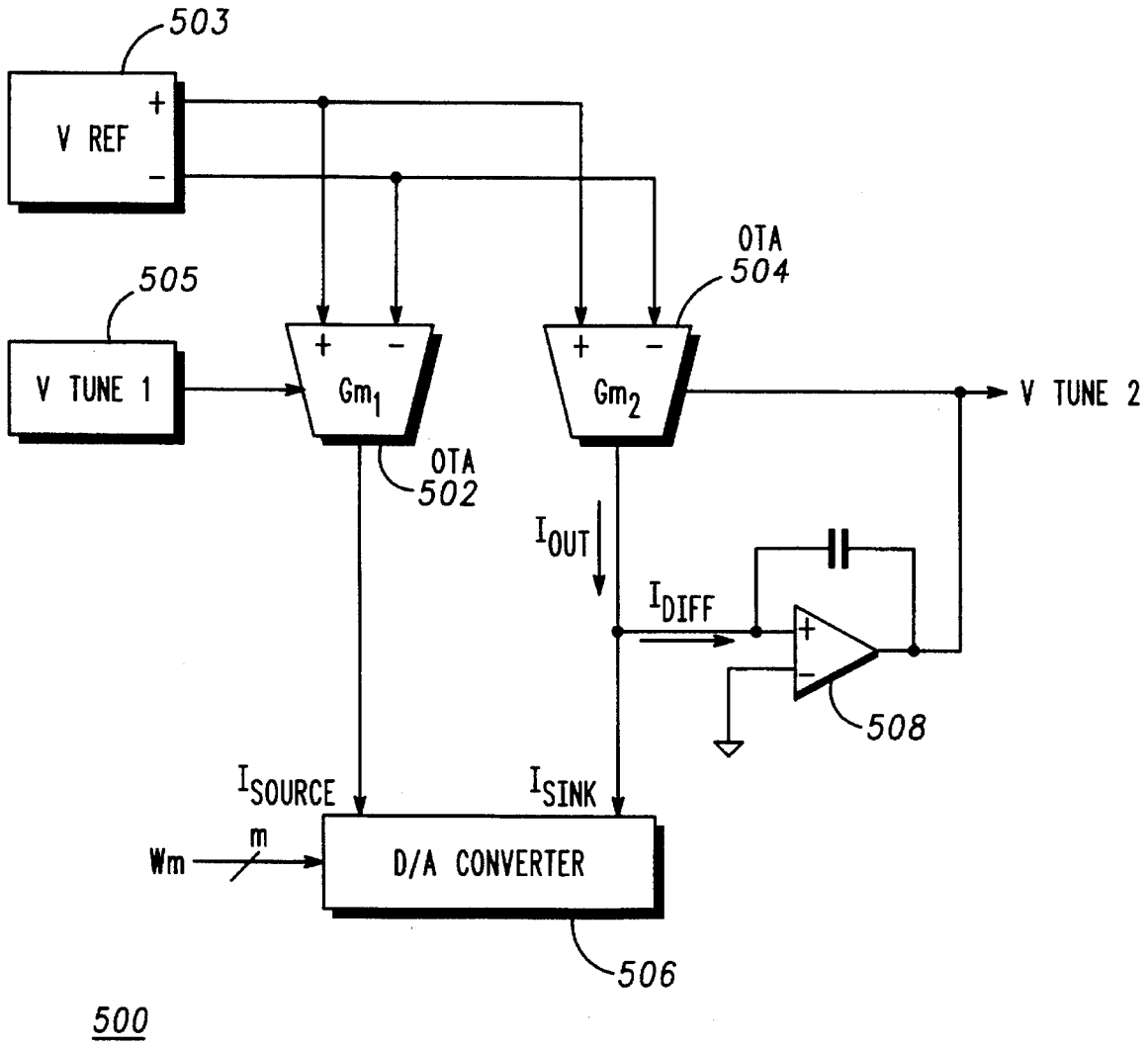
FIG. 5 is a MOS transconductance scaling circuit in accordance with the present invention.

Referring now to FIG. 5, there is shown a MOS OTA scaling circuit 500 in accordance with the present invention. The OTA scaling circuit 500 includes first and second OTAs 502 and 504 the OTA scaling circuit further preferably includes a reference voltage generator 503 and a turning voltage generator 505. Each OTA 502, 504 is characterized by its respective transconductance, $Gm_1$ and $Gm_2$, which is controlled by a tuning voltage, $V_{tune1}$ for Gm1 and $V_{tune2}$ for Gm2. The pair of OTAs 502, 504 are driven from a DC voltage reference generator 503 which generates the reference voltage Vref. As the result, OTA 502 sources an amount of current given by the equation:

$$Isource = Gm_1 \times Vref.$$

The transconductance Gm 1 is set by the tuning voltage $V_{tune1}$, ($Gm_1$= f(Vtune1). The first OTA 502 behaves essentially as a reference OTA which sets a stable transconductance and source current with respect to temperature and process. The tuning voltage generator 505 which generates the tuning voltage $V_{tune1}$ can be some type of reference transconductance setting circuit such as a bandgap voltage reference or a transconductance tuning phase locked loop. The source current, Isource, is used as the input current for a current mode digital to analog converter (D/A) 506. The D/A circuit 506 converts the source current, Isource, using an arbitrary function, into an output sinking current, Isink, that is characterized by the equation:

$$Isink=Isource\times f(W_m),$$

where Wm is an m-bit digital programming word, such as from ($W_m$: 0, 2, . . . , $2^m-1$). The relationship $f(W_m)$ can be any desired function such as a linear function or some arbitrary non-linear function. The Isink current is then provided to the output of OTA 504 while OTA 504, which is being driven by the same Vref input as OTA 502, produces an output current, Iout. The OTA 504 output current, Iout, is a function of the fixed input voltage, Vref, multiplied by the transconductance $Gm_2$. The tuning voltage, $V_{tune2}$, tunes the transconductance, $Gm_2$, therefore, the output current, Iout, can also be varied by adjusting the tuning voltage $V_{tune2}$.

An integrator consisting of an operational amplifier 508 and capacitor 510 forces the OTA 504 output current Iout to equal the D/A output current Isink by regulating the transconductance tuning voltage $V_{tune2}$. The integrator acts as a negative feedback loop that adjusts $V_{tune2}$ in order to keep the current entering into the operational amplifier 508, Idiff, at zero, thus forcing Iout to equal Isink. As a result, the transconductance $Gm_2$ is given by:

$$\begin{aligned} Gm_2 &= Iout/Vref \\ &= Isink/Vref \\ &= Gm_1 \times f(Wm). \end{aligned}$$

This equation indicates that $Gm_2$ can be programmed relative to $Gm_1$ through the digital input to the D/A circuit 506. So, based on the digital code word, the output tuning voltage $V_{tune2}$ indirectly represents the scaled transconductance of OTA 504. The tuning voltage $V_{tune2}$ can then be used as a scaling output to drive other OTAs.

The OTA scaling circuit 500 of the present invention allows the tuning voltage $V_{tune2}$ to compensate for variations in the source current while still allowing the scaling to be controlled by the digital code word. The scaling function can therefore be characterized by the following equation:

$$Isink/Isource= f(W_m),$$

which overcomes the problems associated with the variations of Isink over process and temperature normally associated with integrated MOS OTA circuits.

By feeding the source current into the D/A 506 and changing the current within the D/A as a function of the digital word, $W_m$, the OTA scaling circuit 500 can scale other OTA circuits either linearly or non linearly. The scaling circuit 500 provides a means of taking any voltage tunable OTA and digitally controlling its transconductance.

As an example, the arbitrary D/A function, $f(W_m)$, can be linear as given by the following equation:

$$Gm_2=k(Wm+1)Gm_1,$$

where k is a scaling constant and again Wm is the m-bit digital programming word. This type of linear Gm scaling can be used to program the −3 dB bandwidth of an OTA-capacitance (OTA-C) filter.

Figure 6:
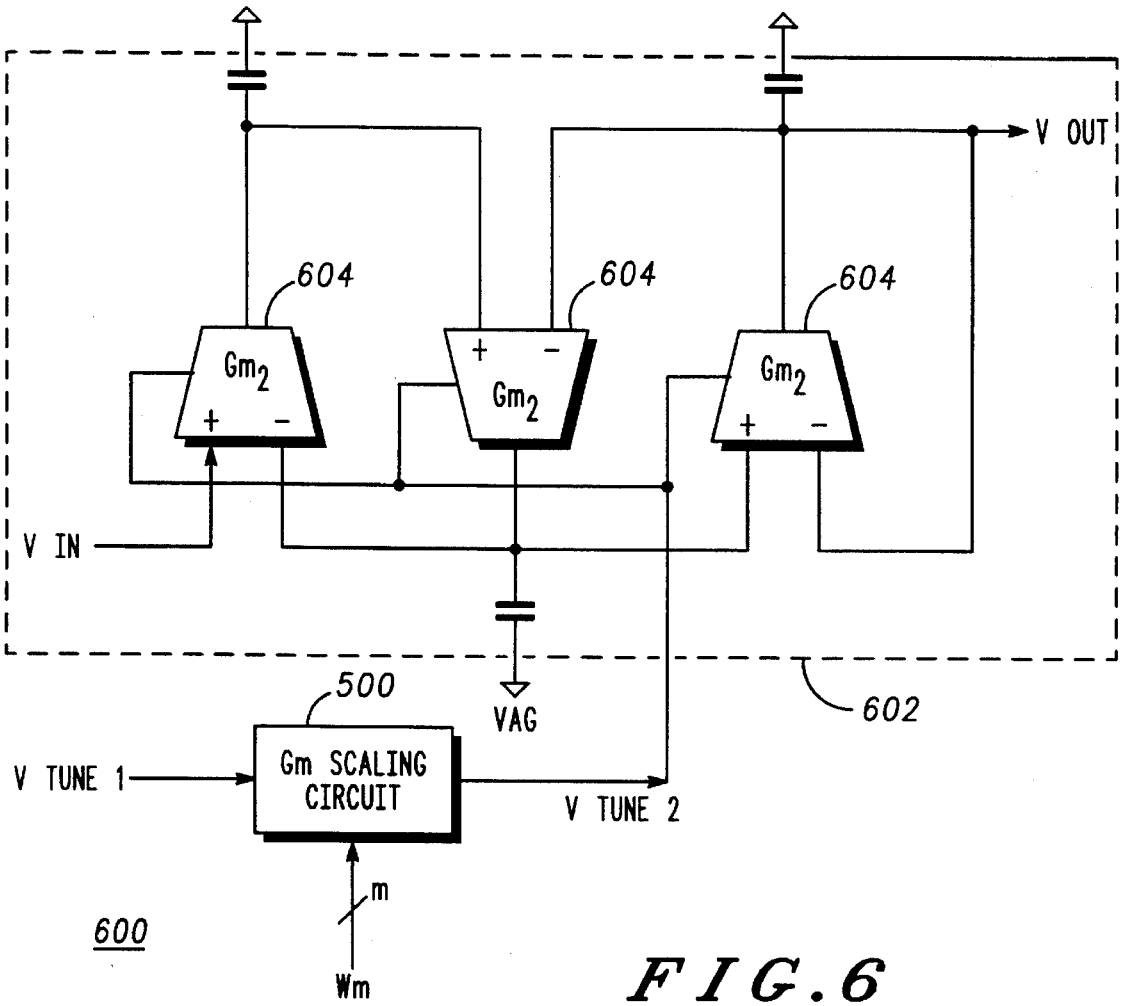
FIG. 6 is an OTA filter circuit in accordance with the present invention.

Referring now to FIG. 6, there is shown an MOS OTA-C filter 602 employing the $G_m$ scaling circuit 500 in accordance with the present invention. The scaling circuit 500 is also referred to as the master portion of the circuit while the OTA filter 602 is referred to as the slave portion of the circuit. Here, the $V_{tune2}$ tuning voltage sets the transconductance, $Gm_2$, for all three OTAs 604 in this third order active filter. By using a linear D/A, such as described in the previous equation, $Gm_2$ can be scaled from $(k)Gm_1$ up to $(2^m k)Gm_1$. Since the OTA-C bandwidth is proportional to Gm/C, this produces a scaling in the −3 dB bandwidth from $(kGm_1)/(2\pi C)$ to $(2^m kGm_1)/(2\pi C)$. Again, $V_{tune1}$ sets the stable reference transconductance, $Gm_1$, which is scaled by the arbitrary D/A function, f(Wm).

In prior art OTA-C filters if only a phase locked loop (PLL) were used for bandwidth programming, then the reference frequency would have to be continuously adjusted. However, this would be impractical in a real system. By using the scaling circuit described by the invention, the source current is adjusted by the PLL such that $Gm_1/C$ is a fixed known quantity which is stable over temperature and process. By feeding the current into the D/A and converting the current within the D/A as a function of a digital word, the filter can be scaled linearly.

Figure 7:
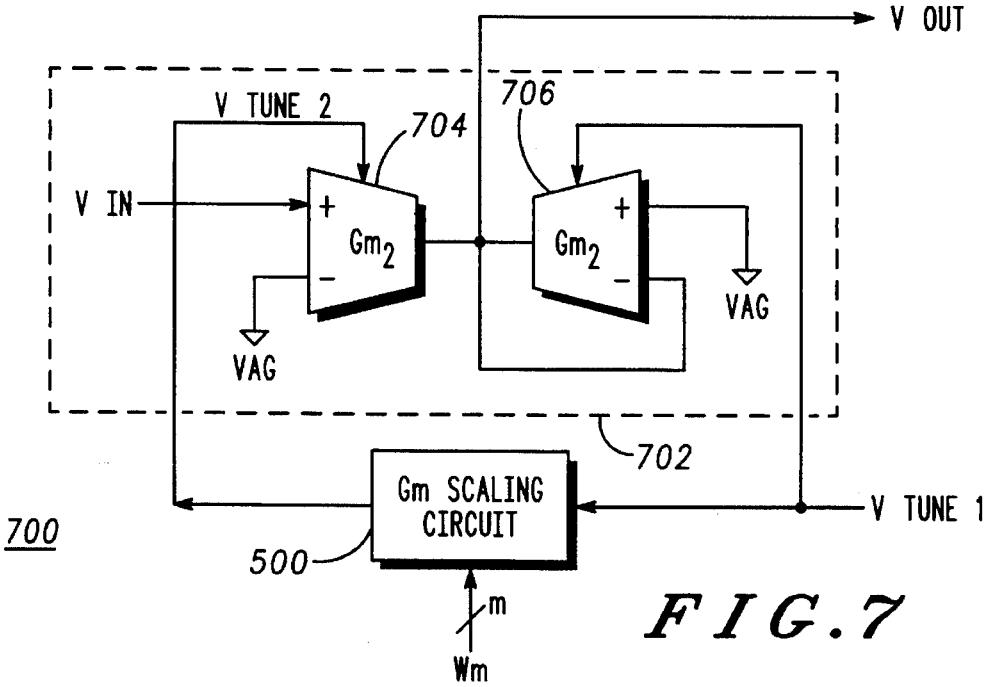
FIG. 7 is an OTA attenuator circuit in accordance with the present invention.

As another example, refer to FIG. 7, where there is shown an attenuator circuit 702 being scaled by the Gm tuning circuit 500 in accordance with the present invention. Here the OTA attenuator stage 702 can be operated with a digitally programmable voltage attenuation by tuning the transconductance $Gm_2$ of the input OTA 704 relative to the fixed transconductance, $Gm_1$, of the voltage follower OTA 706.

Here $Gm_2$ can be an exponential transfer characteristic with respect to $Gm_1$ as given by the following equation:

$$Gm_2=k1\ \exp(-k2W_m)Gm_1, \text{ and}$$

the voltage attenuation is given by:

$$\begin{aligned} \text{attenuation} &= \Delta Vin/\Delta Vout = Gm_1/Gm_2 \\ &= k1\ \exp(k2W_m), \end{aligned}$$

where k1 and k2 are constants and Wm is the m-bit programming word. Thus, a "linear-to-dB" digital programming of the voltage attenuation is implemented. Furthermore, the bandwidth of the attenuator circuit 702 remains essentially impervious to the attenuation setting. The transconductance tuning circuit 500 as described in combination with the attenuator circuit 702 eliminates the need for resistor-divider networks in attenuator circuits and thus offers a significant savings in silicon die area.

By taking a digital word and providing a tuning voltage that indirectly represents transconductance, in the manner described by the invention, other MOS OTA circuits can be driven with high precision and little variation over process and temperature changes. The transconductance of other OTAs slaved off of this scaling circuit are thus forced to a precision transconductance.

In today's integrated circuits (IC) it is not uncommon to have multiple OTAs performing various filtering functions and attenuation functions within a single IC. The scaling circuit as described by the invention provides a way for controlling each one of these OTA functions using a digital word to independently program each OTA circuit. Each OTA circuit used in an integrated circuit can be slaved off of a single master OTA using $Gm_1$, regardless of the function of the slaved circuit. Thus, a "local" regulation circuit is provided that can program, for example, the attenuation or bandwidth of multiple OTA circuits.

Hence, a MOS integrated circuit has been provided that uses feedback to implement a digitally programmable current scaling function.

What is claimed is:

1. A metal-oxide-semiconductor (MOS) integrated circuit, comprising:

an operational transconductance amplifier (OTA) having an input for receiving a reference voltage, a tuning input for receiving a tuning voltage and an output for providing an output current in response to the reference voltage and the tuning voltage;

a digital to analog converter having an input for receiving a digital code word and an output coupled to the output of the operational transconductance amplifier for providing an analog current signal in response to the digital code word; and a feedback loop coupled between the tuning input of the OTA and the output of the digital to analog converter, said feedback loop varying the tuning voltage in response to the analog current signal and the output current, the feedback loop configured for providing the tuning voltage as a current scaling output.

2. A MOS integrated circuit as described in claim 1, wherein the digital to analog converter further includes a current input for receiving an input reference current, the digital to analog converter providing the analog current signal in response to the code word and the input reference current, and wherein the feedback loop maintains said analog current signal substantially equal to said output current in response to the tuning voltage.

3. A MOS integrated circuit as described in claim 1, wherein the feedback loop is configured for providing the tuning voltage as a linear current scaling output.

4. A MOS integrated circuit as described in claim 1, wherein the feedback loop is configured for providing the tuning voltage as a non-linear current scaling output.

5. A method of providing a linear current scaling function within a metal-oxide-semiconductor (MOS) integrated circuit, the method comprising the steps of:

receiving a digital code word, establishing a source current and providing a sink current in response to the digital code word and the source current;

providing the sink current to an operational transconductance amplifier (OTA), the OTA including a tuning input;

establishing a feedback voltage in response to the sink current and providing the feedback voltage to the OTA tuning input to tune the OTA in response to the sink current; and providing the feedback voltage as the linear current scaling output.

6. A method of providing a linear current scaling function within a MOS integrated circuit as described in claim 5, the method further comprising the steps of:

providing an output current from the OTA in response to a reference voltage and the feedback voltage; and adjusting the feedback voltage to equalize the output current to the sink current.

7. A method of providing a current scaling metal-oxide-semiconductor (MOS) circuit, the method comprising the steps of:

generating a digital code word;

generating a source current;

providing a digital to analog converter having a first input for receiving the digital code word, a second input for receiving the source current and an output, the digital to analog converter producing a current sink signal at the output in response to the source current and the digital code word;

providing a voltage tunable operational transconductance amplifier (OTA), the OTA having an output coupled to the output of the analog to digital converter, an input configured to receive a reference voltage, and a tuning input;

generating a feedback voltage in response to the current sink signal and providing the feedback voltage to the tuning input of the voltage tunable OTA;

generating an output current at the output of the voltage tunable OTA in response to the feedback voltage;

equalizing the output current generated at the output of the voltage tunable OTA to the current sink signal using said feedback voltage; and providing said feedback voltage as an output of the current scaling circuit.

8. A scaling circuit for metal-oxide-semiconductor (MOS) integrated circuits, the scaling circuit comprising:

an input configured for receiving a variable digital code word, the digital code word having a code word value of a plurality of code word values; and a MOS operational transconductance amplifier (OTA), said MOS OTA being characterized by a variable transconductance, said variable transconductance having a transconductance value of a plurality of transconductance values, the transconductance value varying as the code word value varies.

9. A scaling circuit as described in claim 8, the scaling circuit further comprising a digital to analog converter coupled to the input for receiving the digital code word and a current source, the current source being coupled to the MOS OTA for providing a current sink output current to the MOS OTA in response to the digital code word, the variable transconductance varying in response to the current sink output current.

10. A scaling circuit as described in claim 9, the scaling circuit further comprising a feed back loop providing a tuning voltage to the MOS OTA, said MOS OTA generating an output current in response to the tuning voltage and said tuning voltage equalizing the output current of the MOS OTA to the current sink output of the digital to analog converter, the tuning voltage being produced in response to a difference between the output current and the current sink output current.

11. An operational transconductance amplifier (OTA) scaling circuit, comprising:

a means for generating a first tuning voltage;

a voltage reference providing a reference voltage;

a first OTA having a tuning input coupled to the means for generating a first tuning voltage for receiving the first tuning voltage, an input coupled to the voltage reference for receiving the reference voltage and an output, the first OTA providing a source current at said output in response to said reference voltage and said first tuning voltage;

a digital to analog converter having a first input for receiving a digital word and a second input coupled to the first OTA output for receiving said source current, the digital to analog converter having an output for providing an output sinking current in response to the digital word and the source current;

a second OTA having an input coupled to the voltage reference for receiving the reference voltage, a tuning input and an output;

a feedback loop having an input coupled to the output of the digital to analog converter and the output of the second OTA and having an output coupled to the tuning input of the second OTA, said feedback loop providing a second tuning voltage to the tuning input of the second OTA; and said second OTA providing an output current at the output of the second OTA in response to the second tuning voltage and the [voltage] reference voltage, said second tuning voltage regulating the output current of the second OTA such that it substantially equals the output sinking current of the digital to analog converter.

12. An OTA scaling circuit as described in claim 11, wherein the means for generating a first tuning voltage comprises a bandgap voltage reference.

13. An OTA scaling circuit as described in claim 11, wherein the means for generating a first tuning voltage comprises a tuning phase locked loop.

14. A method for scaling an operational transconductance amplifier (OTA) circuit, the OTA circuit having a scaling input, the method comprising the steps of:

generating a source current;

generating a reference voltage;

generating a digital word;

scaling the source current in response to the digital word;

generating a sink current in response to the scaled source current;

providing an OTA having an input for receiving the reference voltage, a tuning input for receiving a tuning voltage and an output, the OTA being responsive to the tuning voltage and the reference voltage;

generating an output current at the output of the OTA in response to the tuning voltage and the reference voltage;

equalizing the output current of the OTA to the sink current by varying the tuning voltage in response to the difference between the output current of the OTA and the sink current; and providing the tuning voltage to the scaling input of the OTA circuit.

15. A method for scaling an OTA circuit as described in claim 14, wherein the tuning voltage is linear.

16. A method for scaling an OTA circuit as described in claim 14, wherein the tuning voltage is non-linear.

17. A method for scaling an OTA circuit as described in claim 14, wherein the OTA circuit comprises an OTA capacitance (OTA-C) filter and the tuning voltage received at the scaling input controls the bandwidth of the OTA-C filter.

18. A method for scaling an OTA circuit as described in claim 14, wherein the OTA circuit comprises an OTA attenuator circuit and the tuning voltage received at the scaling input controls the gain of the OTA attenuator circuit.

* * * * *

UNITED STATES PATENT AND TRADEMARK OFFICE

CERTIFICATE OF CORRECTION

PATENT NO. : 5,530,399

DATED : June 25, 1996

INVENTOR(S) : Chambers et al.

It is certified that error appears in the above-indentified patent and that said Letters Patent is hereby corrected as shown below:

Claim 11:

In column 7, line 15, please delete " [voltage] ".

Signed and Sealed this

Twenty-second Day of October, 1996

*Attest:*

Bruce Lehman

BRUCE LEHMAN

*Attesting Officer*

*Commissioner of Patents and Trademarks*